United States Patent [19]

Johnson

[11] 4,138,909

[45] Feb. 13, 1979

[54] BOLT EXTRACTOR

[76] Inventor: Stephen Johnson, 1728 Durand St., Saginaw, Mich. 48602

[21] Appl. No.: 856,671

[22] Filed: Dec. 2, 1977

[51] Int. Cl.[2] ..... B25B 27/00

[52] U.S. Cl. ..... 81/53.2

[58] Field of Search ..... 81/53.2; 29/427; 219/99

[56] References Cited

U.S. PATENT DOCUMENTS

| | | | |
|---|---|---|---|
| 2,429,967 | 10/1947 | Sorensen | 81/53.2 |
| 3,279,047 | 10/1966 | Cumberland | 81/53.2 |
| 3,439,567 | 4/1969 | Denis | 81/53.2 |

*Primary Examiner*—James L. Jones, Jr.
*Attorney, Agent, or Firm*—Learman & McCulloch

[57] ABSTRACT

A bolt extractor for extracting broken bolt or tap shanks from threaded bores. A length of welding rod is fixedly seated within a bore in a headed stud to project from opposite ends of the stud. The stud shank, which is of a diameter less than that of the tapped bore, is encased with electrical insulating material. The end of the welding rod projecting from the shank is welded to the bolt or tap which is to be extracted by conventional welding equipment connected to the welding rod of the extractor. The broken bolt or tap is then extracted from its bore by applying a wrench to the head of the stud.

1 Claim, 1 Drawing Figure

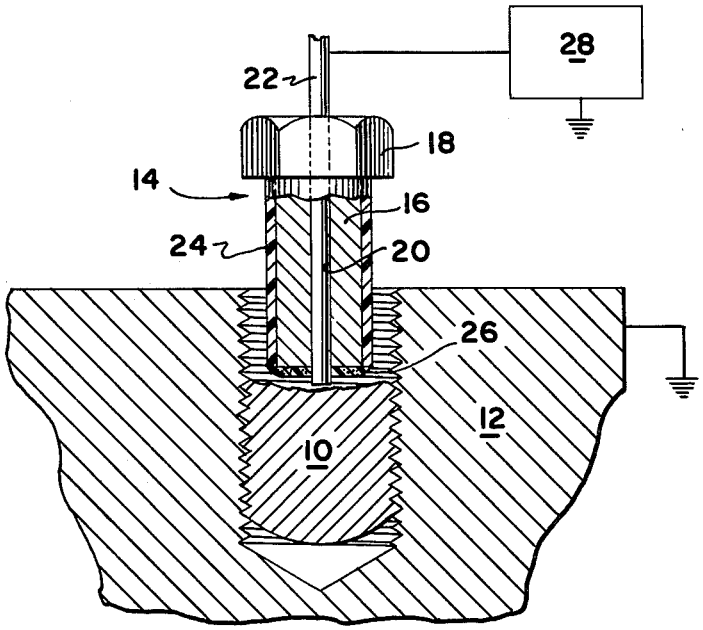
28
22
18
14
16
24
20
26
12
10

BOLT EXTRACTOR

BACKGROUND OF THE INVENTION

The problem of extracting a broken bolt from a tapped bore is a commonly encountered problem and many arrangements have been proposed for performing this particular task. Frequently the bolt shank breaks off at a location below the surface of the part in which the bolt is threaded, and in these cases the standard method of procedure is to first bore or form some type of non-circular recess into the bolt shank to receive the end of a tool which can be turned to apply a torque unthreading the bolt shank from the tapped bore. This particular process is time consuming and can be extremely difficult in most cases where the bolt or a tap is of a relatively hard or heat treated metal.

The present invention is especially directed to the provision of a bolt extracting device which does not require the formation of any holes or opening in the bolt or tap to be extracted.

SUMMARY OF THE INVENTION

A bolt extractor according to the present invention consists basically of a welding rod coaxially mounted within and projecting from opposite ends of a headed stud whose shank is encased with an electrical insulating material. The extractor can be gripped in the conventional manner in a welding rod holder and that end of the welding rod which projects from the stud shank is simply welded directly to the bolt shank which is to be extracted. This action in effect fixedly secures a projecting wrench engageable head to the broken bolt shank so that the shank can be extracted from the bore either manually or by the application of a wrench to the stud head.

Other objects and features of the invention will become apparent by reference to the following specification and to the drawing.

IN THE DRAWING

The single FIGURE of the drawing shows, in partial section, a bolt extractor embodying the present invention in a typical use.

In the drawing, the invention is shown being used to extract a broken bolt shank 10 which has snapped off within a threaded bore in a metal part 12.

A bolt extractor designated generally 14 embodying the present invention includes a stud 16 which is formed with an integral hexagonal head 18 at one end. A coaxial bore 20 extending through the stud fixedly receives a length of welding rod 22 which projects axially from bolt ends of the stud. The shank 16 of the stud is encased with electrical insulating material which may include a length of heat shrinkable electrical insulating material 24 on the periphery of the shank and a coating of an air dried electrical insulating material 26 applied to the lower end of the stud shank.

The manner in which the bolt extractor is employed is believed apparent from the drawing. A conventional welding current supply source shown schematically at 28 is connected to the welding rod 22 of the bolt extractor and to the body 12 within which the bolt shank is seated. That end of the welding rod 22 which projects from the shank end of the extractor is then welded directly to the broken bolt 20, thus fixedly securing the extractor 14 to the broken bolt shank 10. The welder is disconnected from the apparatus and the broken shank 10 is unthreaded from the bore by rotation of the stud. The hexagonal head 18 enables the use of a conventional wrench in the extracting operation, if necessary.

As is apparent from the drawing, the general dimensions of the bolt extractor will be related to the dimensions of the threaded bore in that the shank diameter of the bolt extractor will be selected to be substantially less than that of the tapped bore. The electrical insulation on the shank prevents the inadvertent welding of the extractor shank to the wall of the tapped bore.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claim.

I claim:

1. A bolt extractor for extracting a bolt shank or the like from a tapped hold comprising a headed stud having a wrench engageable head and a shank of a diameter less than that of the hole from which a bolt shank is to be removed, said stud having a coaxial bore therein, a welding rod fixedly mounted in said bore and projecting axially from opposite ends of said stud, and electrical insulation means encasing the shank of said stud.

* * * * *